US008208675B2

(12) United States Patent
Jiang et al.

(10) Patent No.: US 8,208,675 B2
(45) Date of Patent: Jun. 26, 2012

(54) LOUDSPEAKER

(75) Inventors: Kai-Li Jiang, Beijing (CN); Lin Xiao, Beijing (CN); Zhou Chen, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 514 days.

(21) Appl. No.: 12/460,270

(22) Filed: Jul. 16, 2009

(65) Prior Publication Data

US 2010/0046784 A1 Feb. 25, 2010

(30) Foreign Application Priority Data

Aug. 22, 2008 (CN) ..... 2008 1 0142020

(51) Int. Cl.
*H04R 25/00* (2006.01)

(52) U.S. Cl. ..... 381/386; 381/380; 381/164; 381/111

(58) Field of Classification Search ..... 381/164, 381/111

See application file for complete search history.

(56) References Cited

U.S. PATENT DOCUMENTS

| | | | | |
|---|---|---|---|---|
| 1,528,774 | A | 3/1925 | Kranz | |
| 4,002,897 | A | 1/1977 | Kleinman et al. | |
| 4,334,321 | A | 6/1982 | Edelman | |
| 4,503,564 | A * | 3/1985 | Edelman et al. | 398/132 |
| 4,641,377 | A | 2/1987 | Rush et al. | |
| 4,766,607 | A | 8/1988 | Feldman | |
| 5,694,477 | A | 12/1997 | Kole | |
| 6,473,625 | B1 * | 10/2002 | Williams et al. | 455/569.1 |
| 6,777,637 | B2 | 8/2004 | Nakayama et al. | |
| 6,803,116 | B2 | 10/2004 | Ikeda | |
| 6,808,746 | B1 | 10/2004 | Dai et al. | |
| 6,921,575 | B2 | 7/2005 | Horiuchi et al. | |
| 7,045,108 | B2 | 5/2006 | Jiang et al. | |
| 7,393,428 | B2 | 7/2008 | Huang et al. | |
| 7,474,590 | B2 | 1/2009 | Watabe et al. | |
| 7,723,684 | B1 | 5/2010 | Haddon et al. | |
| 7,799,163 | B1 | 9/2010 | Mau et al. | |
| 2001/0005272 | A1 | 6/2001 | Buchholz | |
| 2002/0076070 | A1 | 6/2002 | Yoshikawa et al. | |
| 2005/0040371 | A1 | 2/2005 | Watanabe et al. | |
| 2005/0201575 | A1 | 9/2005 | Koshida et al. | |
| 2006/0104451 | A1 | 5/2006 | Browning et al. | |

(Continued)

FOREIGN PATENT DOCUMENTS

CN 2779422 Y 5/2006

(Continued)

OTHER PUBLICATIONS

Lin Xiao, Zhuo Chen, Chen Feng, Liang Liu et al., Flexible, Stretchable, Transparent Carbon Nanotube Thin Film Loudspeakers, Nano Letters, 2008, pp. 4539-4545, vol. 8, No. 12, US.

(Continued)

*Primary Examiner* — Davetta W Goins
*Assistant Examiner* — Jasmine Pritchard
(74) *Attorney, Agent, or Firm* — Altis Law Group, Inc.

(57) ABSTRACT

A loudspeaker includes an enclosure and at least one sound wave generator disposed in the enclosure. The sound wave generator includes at least one carbon nanotube structure. The carbon nanotube structure is capable of converting electrical signals into heat. The heat is transferred to a medium and causes a thermoacoustic effect.

18 Claims, 19 Drawing Sheets

U.S. PATENT DOCUMENTS

| | | | | |
|---|---|---|---|---|
| 2006/0147081 | A1* | 7/2006 | Mango et al. | 381/398 |
| 2006/0264717 | A1 | 11/2006 | Pesach et al. | |
| 2007/0166223 | A1 | 7/2007 | Jiang et al. | |
| 2008/0095694 | A1 | 4/2008 | Nakayama et al. | |
| 2008/0170982 | A1* | 7/2008 | Zhang et al. | 423/447.3 |
| 2009/0016951 | A1 | 1/2009 | Kawabata et al. | |
| 2009/0085461 | A1 | 4/2009 | Feng et al. | |
| 2009/0096346 | A1 | 4/2009 | Liu et al. | |
| 2009/0096348 | A1 | 4/2009 | Liu et al. | |
| 2009/0145686 | A1 | 6/2009 | Watabe et al. | |
| 2009/0153012 | A1 | 6/2009 | Liu et al. | |
| 2009/0167137 | A1 | 7/2009 | Liu et al. | |
| 2010/0054502 | A1 | 3/2010 | Miyachi | |
| 2010/0054507 | A1 | 3/2010 | Oh et al. | |
| 2011/0171419 | A1 | 7/2011 | Li et al. | |
| 2012/0000293 | A1* | 1/2012 | Baughman et al. | 73/861.08 |

FOREIGN PATENT DOCUMENTS

| | | |
|---|---|---|
| CN | 2787870 | 6/2006 |
| CN | 1821048 | 8/2006 |
| CN | 1886820 | 12/2006 |
| CN | 201150134 | 11/2008 |
| CN | 101471213 | 7/2009 |
| CN | 101400198 | 9/2010 |
| JP | 49-24593 | 3/1974 |
| JP | 60-22900 | 2/1985 |
| JP | 1-255398 | 10/1989 |
| JP | 3-147497 | 6/1991 |
| JP | 4-126489 | 4/1992 |
| JP | 11-300274 | 11/1999 |
| JP | 2002-186097 | 6/2002 |
| JP | 2003198281 | 7/2003 |
| JP | 2003-266399 | 9/2003 |
| JP | 2003-319490 | 11/2003 |
| JP | 2004229250 | 8/2004 |
| JP | 2005-51284 | 2/2005 |
| JP | 2005-73197 | 3/2005 |
| JP | 2005189322 | 7/2005 |
| JP | 2005-341554 | 12/2005 |
| JP | 2005333601 | 12/2005 |
| JP | 2007-187976 | 7/2007 |
| JP | 2008-101910 | 5/2008 |
| JP | 2009-91239 | 4/2009 |
| JP | 2009-94074 | 4/2009 |
| JP | 2009-146896 | 7/2009 |
| JP | 2009-146898 | 7/2009 |
| KR | 10-0761548 | 9/2007 |
| TW | 200740976 | 11/2007 |
| TW | 200744399 | 12/2007 |
| WO | WO0073204 | 12/2000 |
| WO | WO2007099975 | 9/2007 |
| WO | WO2008/029451 | 3/2008 |

OTHER PUBLICATIONS

Kaili Jiang, Qunqing Li, Shoushan Fan, Spinning continuous carbon nanotube yarns, Nature, Oct. 24, 2002, pp. 801, vol. 419.

Yang Wei, Kaili Jiang, Xiaofeng Feng, Peng Liu et al., Comparative studies of multiwalled carbon nanotube sheets before and after shrinking, Physical Review B, Jul. 25, 2007, vol. 76, 045423.

Strutt John William, Rayleigh Baron, The Theory of Sound, 1926, pp. 226-235, vol. 2.

Swift Gregory W., Thermoacoustic Engines and Refrigerators, Physics Today, Jul. 1995, pp. 22-28, vol. 48.

William Henry Preece, On Some Thermal Effects of Electric Currents, Proceedings of the Royal Society of London, 1879-1880, pp. 408-411, vol. 30.

W. Yi, L.Lu, Zhang Dianlin et al., Linear Specific Heat of Carbon Nanotubes, Physical Review B, Apr. 1, 1999, vol. 59, No. 14, R9015-9018.

Frank P. Incropera, David P. Dewitt et al., Fundamentals of Heat and Mass Transfer, 6th ed., 2007, pp. A-5, Wiley:Asia.

Lina Zhang, Chen Feng, Zhuo Chen, Liang Liu et al., Superaligned Carbon Nanotube Grid for High Resolution Transmission Electron Microscopy of Nanomaterials, Nano Letters, 2008, pp. 2564-2569, vol. 8, No. 8.

H.D. Arnold, I.B. Crandall, The Thermophone as a Precision Source of Sound, Physical Review, 1917, pp. 22-38, vol. 10.

http://www.physorg.com/news123167268.html.

P. De Lange, On Thermophones, Proceedings of the Royal Society of London. Series A, Apr. 1 1915, pp. 239-241, vol. 91, No. 628.

Kai Liu, Yinghui Sun, Lei Chen, Chen Feng, Xiaofeng Feng, Kaili Jiang et al., Controlled Growth of Super-Aligned Carbon Nanotube Arrays for Spinning Continuous Unidirectional Sheets with Tunable Physical Properties, Nano Letters, 2008, pp. 700-705, vol. 8, No. 2.

Braun Ferdinand, Notiz uber Thermophonie, Ann. Der Physik, Apr. 1898, pp. 358-360,vol. 65.

J.J.Hopfield, Spectra of Hydrogen, Nitrogen and Oxygen in the Extreme Ultraviolet, Physical Review, 1922, pp. 573-588,vol. 20.

Zhuangchun Wu, Zhihong Chen, Xu Du et al.,Transparent, Conductive Carbon Nanotube Films, Science, Aug. 27, 2004, pp. 1273-1276, vol. 305.

Mei Zhang, Shaoli Fang, Anvar A. Zakhidov, Sergey B. Lee et al., Strong, Transparent, Multifunctional, Carbon Nanotube Sheets, Science, Aug. 19, 2005, pp. 1215-1219, vol. 309.

Xiaobo Zhang, Kaili Jiang, Chen Feng, Peng Liu et al., Spinning and Processing Continuous Yarns from 4-Inch Wafer Scale Super-Aligned Carbon Nanotube Arrays, Advanced Materials, 2006, pp. 1505-1510, vol. 18.

Edward C. Wente, The Thermophone, Physical Review, 1922, pp. 333-345,vol. 19.

Chen, Huxiong; Diebold, Gerald, "Chemical Generation of Acoustic Waves: A Giant Photoacoustic Effect", Nov. 10, 1995, Science, vol. 270, pp. 963-966.

Amos, S.W.; "Principles of Transistor Circuits"; 2000; Newnes-Butterworth-Heinemann; 9th ed.;p. 114.

Lee et al., Photosensitization of nonlinear scattering and photoacoustic emission from single-walled carbon nanotubes, Applied Physics Letters, Mar. 13, 2008, 92, 103122.

Alexander Graham Bell, Selenium and the Photophone, Nature, Sep. 23, 1880, pp. 500-503.

Silvanus P. Thompson, The Photophone, Nature, Sep. 23, 1880, vol. XXII, No. 569, pp. 481.

* cited by examiner

LOUDSPEAKER

RELATED APPLICATIONS

This application is related to a application entitled, "HEADPHONE", filed Jul. 16, 2009 Ser. No. 12/460,271.

BACKGROUND

1. Technical Field

The present disclosure relates to loudspeakers and, particularly, to a carbon nanotube based loudspeaker.

2. Description of Related Art

Loudspeakers are apparatus that reproduce sound recorded in different media. The loudspeaker commonly includes an enclosure (i.e., housing, box, or cabinet) and a sound wave generator disposed in the enclosure. The loudspeakers can be divided into passive loudspeakers and active loudspeakers. The active loudspeakers are any loudspeakers that contain their own amplifiers (e.g. those for computers or i-pods), or loudspeakers that divide the frequencies for each sound wave generator before power-amplification, using an active crossover. The passive loudspeakers are loudspeakers without amplifiers.

The enclosure generally is a shell structure defining a hollow space therein, made of wood, ceramic, plastic, resin, or other suitable material. The sound wave generator inside the enclosure is used to transform an electrical signal into a sound pressure that can be heard by human ears.

There are different types of sound wave generators that can be categorized according by their working principle, such as electro-dynamic sound wave generators, electromagnetic sound wave generators, electrostatic sound wave generators and piezoelectric sound wave generators. However, the various types ultimately use mechanical vibration to produce sound waves, in other words they all achieve "electro-mechanical-acoustic" conversion. Among the various types, the electro-dynamic sound wave generators are most widely used.

Referring to FIG. 19, a typical passive loudspeaker 10 according to the prior art with an electro-dynamic sound wave generator 100, includes an enclosure 110. The sound wave generator 100 is disposed in the enclosure 110. The sound wave generator 100 is mounted on a front panel of the enclosure 110. The sound wave generator 100 includes a voice coil, a magnet and a cone. The voice coil is an electrical conductor, and is placed in the magnetic field of the magnet. By applying an electrical current to the voice coil, a mechanical vibration of the cone is produced due to the interaction between the electromagnetic field produced by the voice coil and the magnetic field of the magnets, thus producing sound waves. However, the structure of the electric-powered sound wave generator 100 is dependent on magnetic fields and often weighty magnets.

Carbon nanotubes (CNT) are a novel carbonaceous material and have received a great deal of interest since the early 1990s. Carbon nanotubes have interesting and potentially useful electrical and mechanical properties, and have been widely used in a plurality of fields.

What is needed, therefore, is to provide a loudspeaker having a CNT structure that is not dependent on magnetic fields.

BRIEF DESCRIPTION OF THE DRAWINGS

Many aspects of the present loudspeaker can be better understood with reference to the following drawings. The components in the drawings are not necessarily to scale, the emphasis instead being placed upon clearly illustrating the principles of the present loudspeaker.

Figure 1:
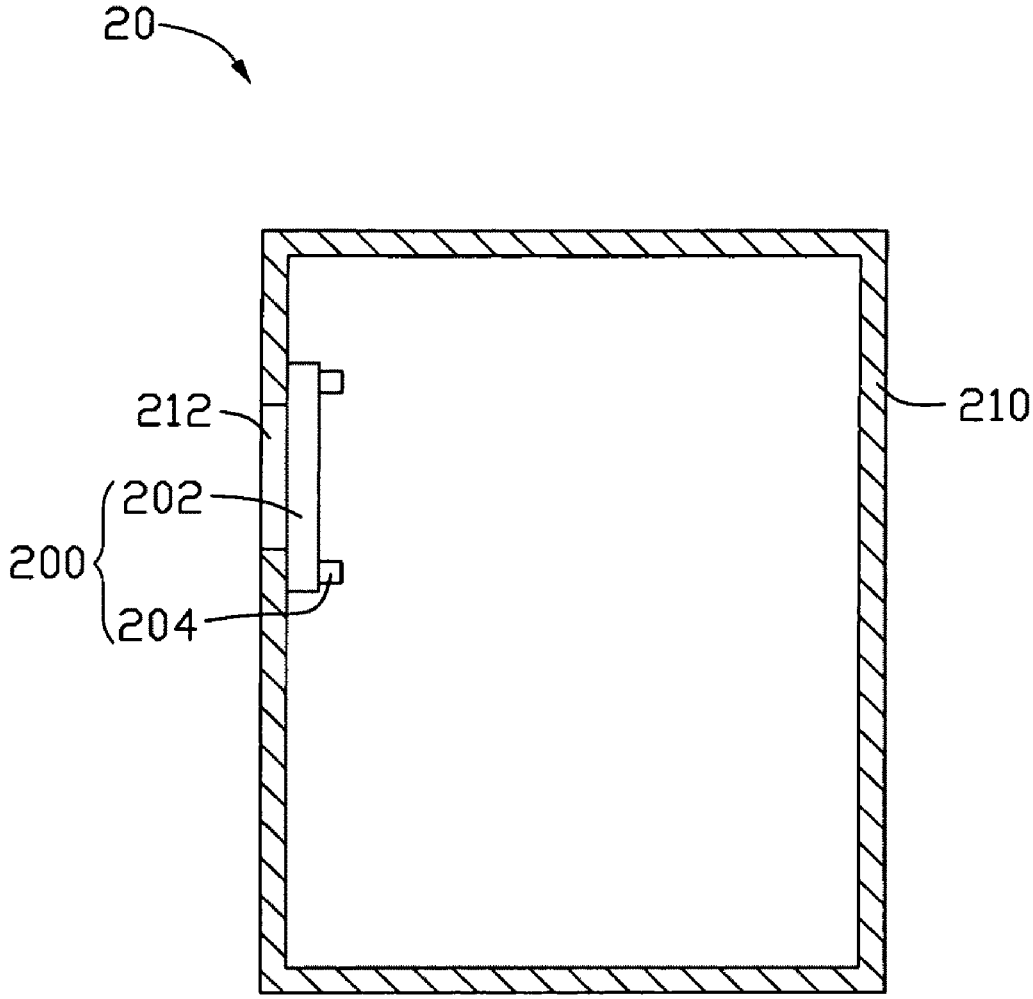
FIG. 1 is a schematic structural view of a loudspeaker in accordance with a first embodiment.

Corresponding reference characters indicate corresponding parts throughout the several views. The exemplifications set out herein illustrate at least one exemplary embodiment of the present loudspeaker, in at least one form, and such exemplifications are not to be construed as limiting the scope of the invention in any manner.

DETAILED DESCRIPTION OF EXEMPLARY EMBODIMENTS

Reference will now be made to the drawings to describe, in detail, embodiments of the present loudspeaker.

Referring to FIG. 1, a closed box type loudspeaker 20 according to a first embodiment includes an enclosure 210, and at least one sound wave generator 200. The enclosure 210 includes at least one first through hole 212 (i.e., opening). Size of the sound wave generator 200 can be substantially equal to or larger than the first through hole 212. The sound wave generator 200 covers the first through hole 212. A closed hollow space is defined by the enclosure 210 and the sound wave generator 200. In one embodiment, the first through hole 212 is defined in a fore wall of the enclosure 210, and the sound wave generator 200 is inside the enclosure 210 and covers the first through hole 212. Air can pass through the sound wave generator 200.

The enclosure 210 can be made of a light-weight but strong material such as wood, bamboo, carbon fiber, glass, diamond, crystal, ceramic, plastic or resin. The enclosure 210 can also comprise of a sound absorbing material.

The sound wave generator 200 includes a carbon nanotube structure 202. The carbon nanotube structure 202 can have many different structures and a large specific surface area (e.g., above 50 $m^2/g$). The heat capacity per unit area of the carbon nanotube structure 202 can be less than $2\times10^{-4}$ $J/cm^2\cdot K$. In one embodiment, the heat capacity per unit area of the carbon nanotube structure 202 is less than or equal to about $1.7\times10^{-6}$ $J/cm^2\cdot K$. In one embodiment, the sound wave generator 200 is a carbon nanotube structure 202 with a large specific surface area contacting to the surrounding medium and a small heat capacity per unit area, and the carbon nanotube structure 202 are composed of the carbon nanotubes.

The carbon nanotube structure 202 can include a plurality of carbon nanotubes uniformly distributed therein, and the carbon nanotubes therein can be combined by van der Waals attractive force therebetween. It is understood that the carbon nanotube structure 202 must include metallic carbon nanotubes. The carbon nanotubes in the carbon nanotube structure 202 can be arranged orderly or disorderly. The term 'disordered' includes, but is not limited to, a structure where the carbon nanotubes are arranged along many different directions, arranged such that the same number of carbon nanotubes arranged along each different direction can be almost the same (e.g. uniformly disordered); and/or entangled with each other. 'Ordered' includes, but not limited to, a structure where the carbon nanotubes are arranged in a consistently systematic manner, e.g., the carbon nanotubes are arranged approximately along a same direction and or have two or more sections within each of which the carbon nanotubes are arranged approximately along a same direction (different sections can have different directions). The carbon nanotubes in the carbon nanotube structure 202 can be selected from a group consisting of single-walled, double-walled, and/or multi-walled carbon nanotubes. It is also understood that there may be many layers of ordered and/or disordered carbon nanotubes in the carbon nanotube structure 202.

The carbon nanotube structure 202 may have a substantially planar structure. The thickness of the carbon nanotube structure 202 may range from about 0.5 nanometers to about 1 millimeter. The smaller the specific surface area of the carbon nanotube structure 202, the greater the heat capacity will be per unit area. The larger the heat capacity per unit area, the smaller the sound pressure level of the acoustic device.

Figure 2:
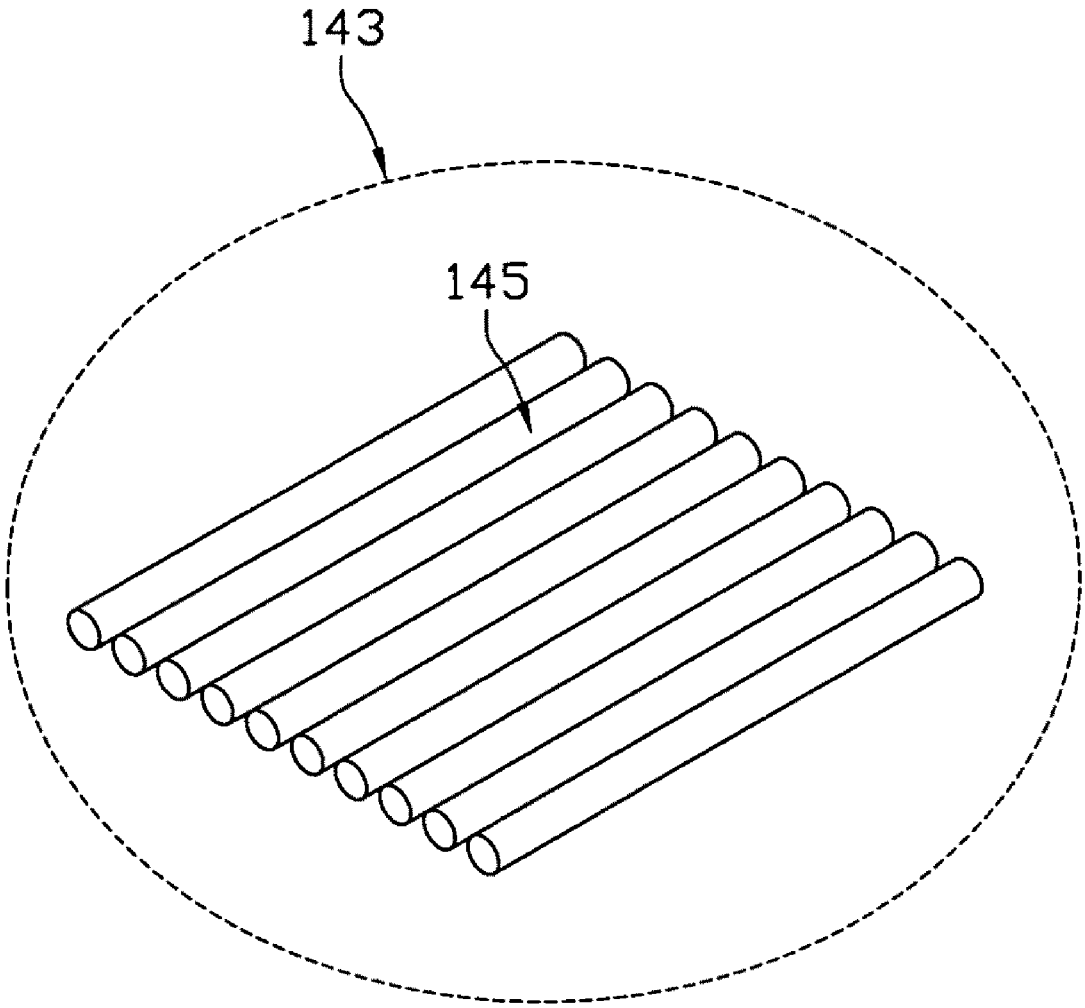
FIG. 2 is a schematic structural view of a carbon nanotube segment in a drawn carbon nanotube film.
Figure 3:
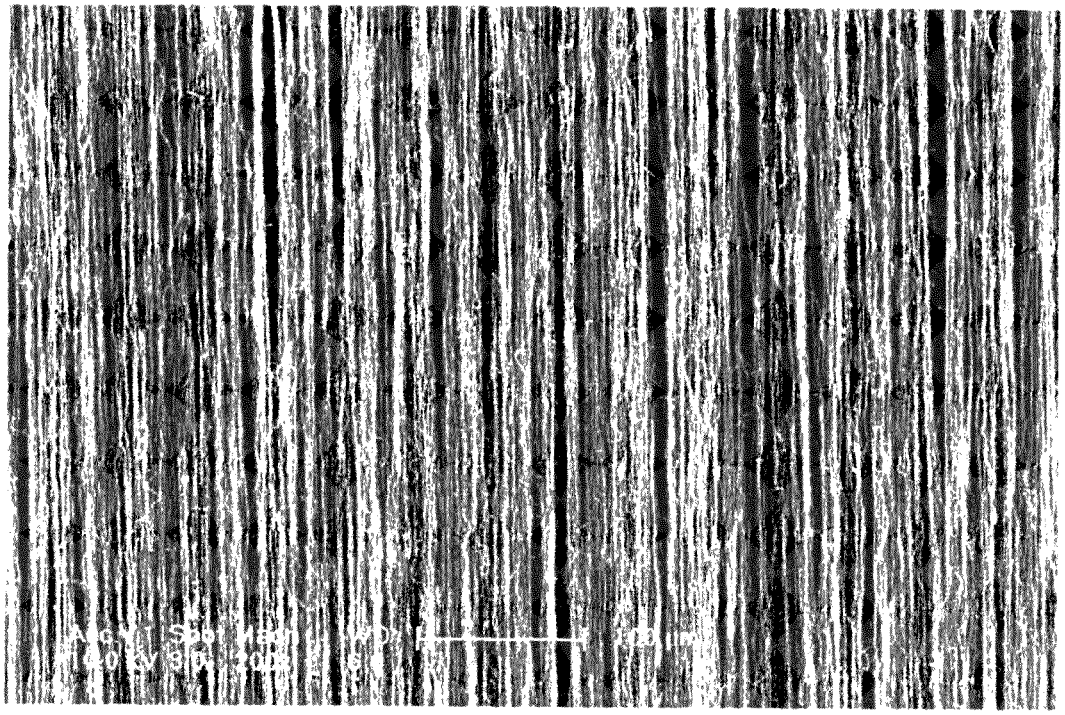
FIG. 3 shows a Scanning Electron Microscope (SEM) image of the drawn carbon nanotube film of FIG. 2.

In one embodiment, the carbon nanotube structure 202 can include at least one drawn carbon nanotube film. Examples of a drawn carbon nanotube film (also known as a yarn) is taught by U.S. Pat. No. 7,045,108 to Jiang et al., and WO 2007015710 to Zhang et al. The drawn carbon nanotube film includes a plurality of successive and oriented carbon nanotubes joined end-to-end by van der Waals attractive force therebetween. The carbon nanotubes in the carbon nanotube film can be substantially aligned in a single direction. The drawn carbon nanotube film can be formed by drawing a film from a carbon nanotube array that is capable of having a film drawn therefrom. Referring to FIGS. 2 to 3, each drawn carbon nanotube film includes a plurality of successively oriented carbon nanotube segments 143 joined end-to-end by van der Waals attractive force therebetween. Each carbon nanotube segment 143 includes a plurality of carbon nanotubes 145 parallel to each other, and combined by van der Waals attractive force therebetween. As can be seen in FIG. 3, some variations can occur in a drawn carbon nanotube film. The carbon nanotubes 145 in the drawn carbon nanotube film are also oriented along a preferred orientation. The plurality of carbon nanotubes 145 joined end-to-end to form the free-standing drawn carbon nanotube film. Free standing includes films that do not have to be, but still can be supported. The carbon nanotube film also can be treated with an organic solvent. After treatment, the mechanical strength and toughness of the treated carbon nanotube film are increased and the coefficient of friction of the treated carbon nanotube films is reduced. The treated carbon nanotube film has a larger heat capacity per unit area and thus produces less of a thermoacustic effect than the corresponding non treated film. A thickness of the carbon nanotube film can range from about 0.5 nanometers to about 100 micrometers. The drawn carbon nanotube film is adhesive in nature. The single drawn carbon nanotube film has a specific surface area of above about 100 $m^2/g$.

The carbon nanotube structure 202 of the sound wave generator 200 can also include at least two stacked carbon nanotube films. In other embodiments, the carbon nanotube structure 202 can include two or more coplanar carbon nanotube films or both coplanar and stacked films. Additionally, an angle can exist between the orientation of carbon nanotubes in adjacent films, stacked or adjacent. Adjacent carbon nanotube films can be combined only by the van der Waals attractive force therebetween. The number of the layers of the carbon nanotube films is not limited. However, as the stacked number of the carbon nanotube films increasing, the specific surface area of the carbon nanotube structure will decrease, and a large enough specific surface area (e.g., above 30 $m^2/g$) must be maintained to achieve the thermoacoustic effect and produce sound effectively. An angle between the aligned directions of the carbon nanotubes in the two adjacent carbon nanotube films can range from above 0° to about 90°. When the angle between the aligned directions of the carbon nanotubes in adjacent carbon nanotube films is larger than 0 degrees, a microporous structure is defined by the carbon nanotubes in carbon nanotube structure. Space exist between adjacent carbon nanotubes. The carbon nanotube structure 202 in an embodiment employing these films will have a plurality of micropores. Stacking the carbon nanotube films will add to the structural integrity of the carbon nanotube structure 202. In some embodiments, the carbon nanotube structure 202 has a free standing structure and does not require the use of structural support.

Figure 4:
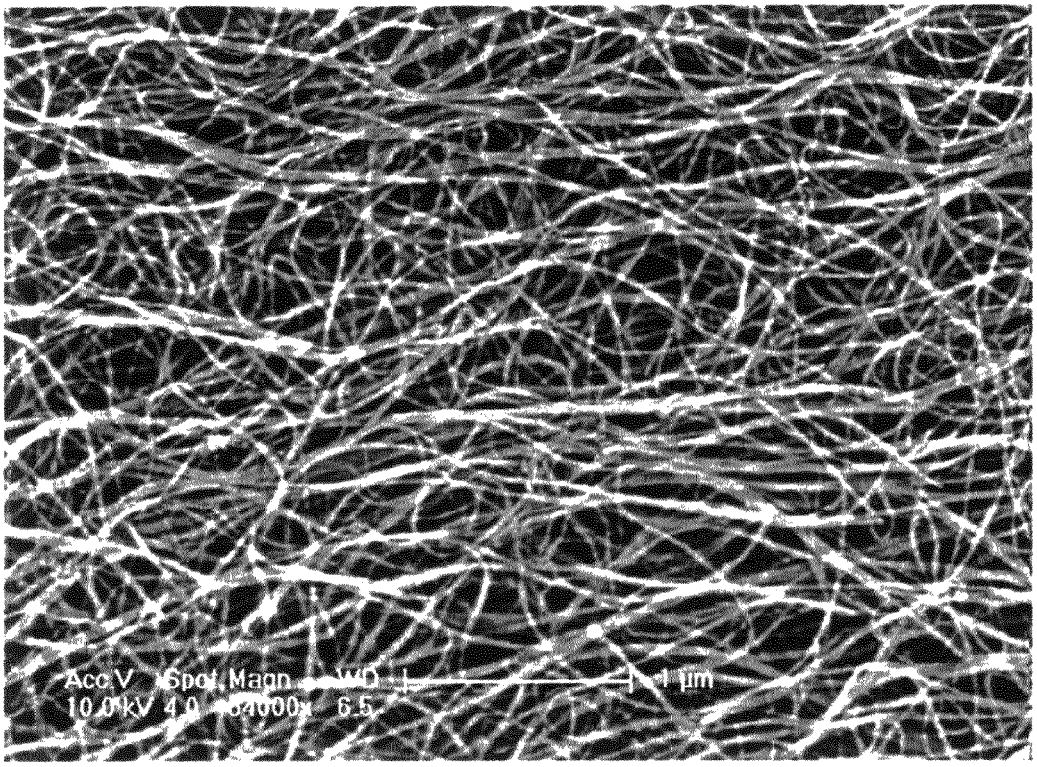
FIG. 4 shows an SEM image of another carbon nanotube film with carbon nanotubes entangled with each other.

In other embodiments, the carbon nanotube structure 202 includes a flocculated carbon nanotube film. Referring to FIG. 4, the flocculated carbon nanotube film can include a plurality of long, curved, disordered carbon nanotubes entangled with each other. A length of the carbon nanotubes can be above 10 centimeters. Further, the flocculated carbon nanotube film can be isotropic. The carbon nanotubes can be substantially uniformly dispersed in the carbon nanotube film. The adjacent carbon nanotubes are acted upon by the van der Waals attractive force therebetween, thereby forming an entangled structure with micropores defined therein. It is understood that the flocculated carbon nanotube film is very porous. Sizes of the micropores can be less than 10 micrometers. The porous nature of the flocculated carbon nanotube film will increase specific surface area of the carbon nanotube structure 202. Further, due to the carbon nanotubes in the carbon nanotube structure 202 being entangled with each other, the carbon nanotube structure 202 employing the flocculated carbon nanotube film has excellent durability, and can be fashioned into desired shapes with a low risk to the integrity of carbon nanotube structure 202. Thus, the sound wave generator 200 may be formed into many shapes. The flocculated carbon nanotube film, in some embodiments, will not require the use of structural support due to the carbon nanotubes being entangled and adhered together by van der Waals attractive force therebetween. The thickness of the flocculated carbon nanotube film can range from about 0.5 nanometers to about 1 millimeter.

Figure 5:
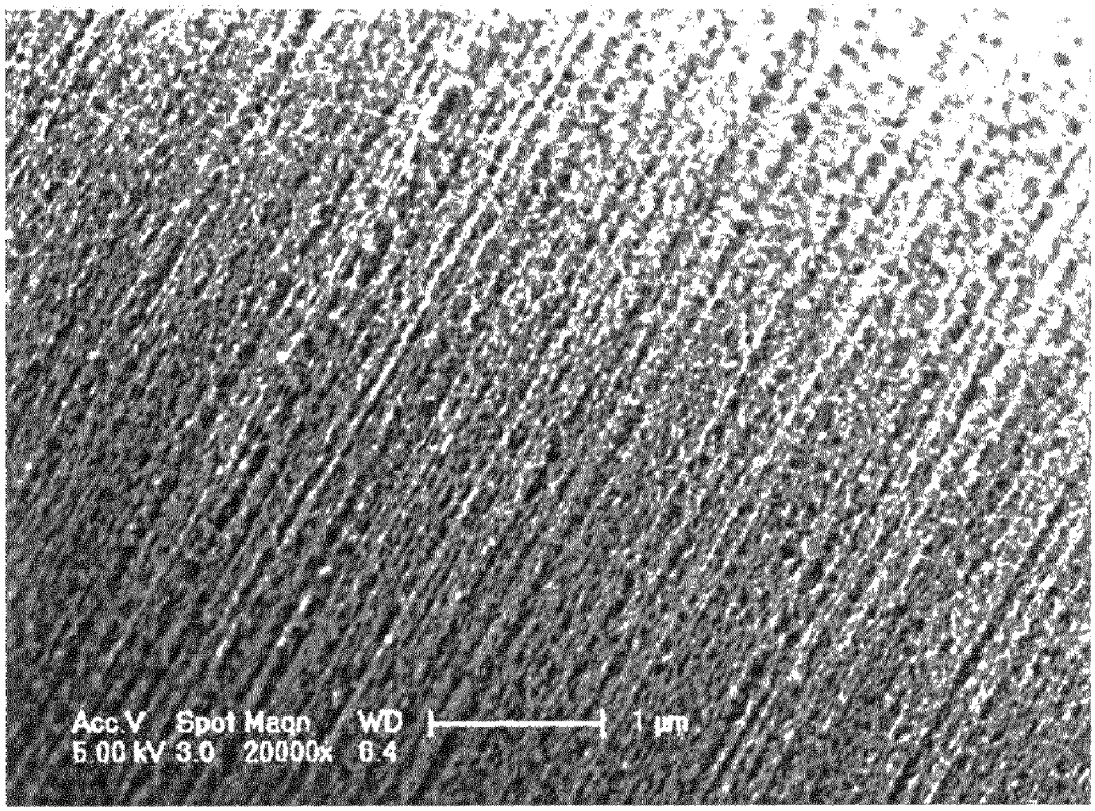
FIG. 5 shows an SEM image of a carbon nanotube segment produced by pushing down a strip-shaped carbon nanotube array.

In other embodiments, the carbon nanotube structure 202 includes a carbon nanotube segment film that comprises of at least one carbon nanotube segment. Referring to FIG. 5, the carbon nanotube segment includes a plurality of carbon nanotubes arranged along a common direction. In one embodiment, the carbon nanotube segment film can comprise one carbon nanotube segment. The carbon nanotubes in the carbon nanotube segment are substantially parallel to each other, have an almost equal length and are combined side by side via van der Waals attractive force therebetween. At least one carbon nanotube will span the entire length of the carbon nanotube segment, so that one of the dimensions of the carbon nanotube segment film corresponds to the length of the segment. Thus, the length of the carbon nanotube segment is only limited by the length of the carbon nanotubes.

In some embodiments, the carbon nanotube segment film can be produced by growing a strip-shaped carbon nanotube array, and pushing the strip-shaped carbon nanotube array down along a direction perpendicular to length of the strip-shaped carbon nanotube array, and has a length ranged from about 1 millimeter to about 10 millimeters. The length of the carbon nanotube segment is only limited by the length of the strip. A carbon nanotube segment film also can be formed by having a plurality of these strips lined up side by side and folding the carbon nanotubes grown thereon over such that there is overlap between the carbon nanotubes on adjacent strips.

In some embodiments, the carbon nanotube film can be produced by a method adopting a "kite-mechanism" and can have carbon nanotubes with a length of even above 10 centimeters. This is considered by some to be ultra-long carbon nanotubes. However, this method can be used to grow carbon nanotubes of many sizes. Specifically, the carbon nanotube film can be produced by providing a growing substrate with a catalyst layer located thereon; placing the growing substrate adjacent to the insulating substrate in a chamber; and heating the chamber to a growth temperature for carbon nanotubes under a protective gas, and introducing a carbon source gas along a gas flow direction, growing a plurality of carbon nanotubes on the insulating substrate. After introducing the carbon source gas into the chamber, the carbon nanotubes starts to grow under the effect of the catalyst. One end (e.g., the root) of the carbon nanotubes is fixed on the growing substrate, and the other end (e.g., the top/free end) of the carbon nanotubes grow continuously. The growing substrate is near an inlet of the introduced carbon source gas, the ultra-long carbon nanotubes float above the insulating substrate with the roots of the ultra-long carbon nanotubes still sticking on the growing substrate, as the carbon source gas is continuously introduced into the chamber. The length of the ultra-long carbon nanotubes depends on the growth conditions. After growth has been stopped, the ultra-long carbon nanotubes land on the insulating substrate. The carbon nanotubes are then separated from the growing substrate. This can be repeated many times so as to obtain many layers of carbon nanotube films on a single insulating substrate. The layers may have an angle from 0 to less than or equal to 90 degrees between them by changing the orientation of the insulating substrate between growing cycles.

The carbon nanotube structure 202 can further include at least two stacked or coplanar carbon nanotube segments. Adjacent carbon nanotube segments can be adhered together by van der Waals attractive force therebetween. An angle between the aligned directions of the carbon nanotubes in adjacent two carbon nanotube segments ranges from 0 degrees to about 90 degrees. A thickness of a single carbon nanotube segment can range from about 0.5 nanometers to about 100 micrometers.

Further, the carbon nanotube film and/or the entire carbon nanotube structure 202 can be treated, such as by laser, to improve the light transmittance of the carbon nanotube film or the carbon nanotube structure 202. For example, the light transmittance of the untreated drawn carbon nanotube film ranges from about 70%-80%, and after laser treatment, the light transmittance of the untreated drawn carbon nanotube film can be improved to about 95%. The heat capacity per unit area of the carbon nanotube film and/or the carbon nanotube structure 202 will increase after the laser treatment.

In other embodiments, the carbon nanotube structure 202 includes one or more carbon nanotube wire structures. The carbon nanotube wire structure includes at least one carbon nanotube wire. A heat capacity per unit area of the carbon nanotube wire structure can be less than $2\times10^{-4}$ J/cm$^2$·K. In one embodiment, the heat capacity per unit area of the carbon nanotube wire structure is less than $5\times10^{-5}$ J/cm$^2$·K. The carbon nanotube wire can be twisted or untwisted. The carbon nanotube wire structure can also comprised of twisted or untwisted carbon nanotube cables. These carbon nanotube cables can include twisted carbon nanotube wires, untwisted carbon nanotube wires, or combination thereof. The carbon nanotube wires in the carbon nanotube cables can be parallel to each other to form a bundle-like structure or twisted with each other to form a twisted structure.

Figure 6:
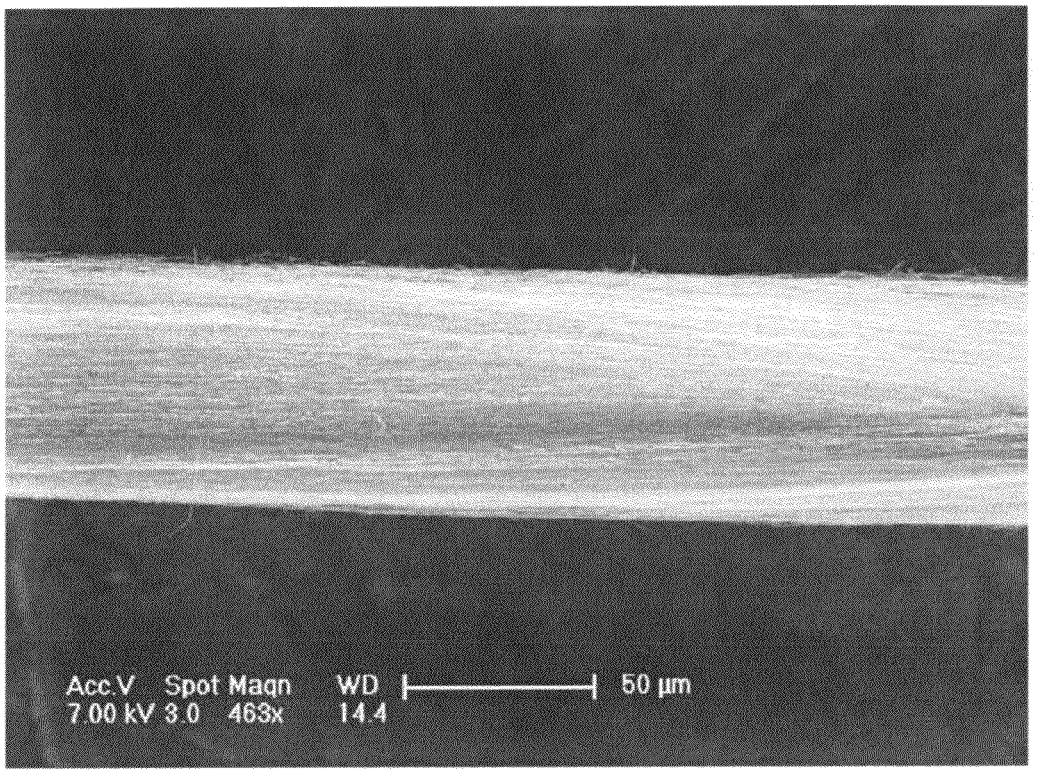
FIG. 6 shows an SEM image of an untwisted carbon nanotube wire.

The untwisted carbon nanotube wire can be formed by treating the drawn carbon nanotube film with an organic solvent. In one embodiment, the drawn carbon nanotube film is treated by applying the organic solvent to the drawn carbon nanotube film to soak the entire surface of the drawn carbon nanotube film. After being soaked by the organic solvent, the adjacent paralleled carbon nanotubes in the drawn carbon nanotube film will bundle together, due to the surface tension of the organic solvent when the organic solvent volatilizing, and thus, the drawn carbon nanotube film will be shrunk into untwisted carbon nanotube wire. Referring to FIG. 6, the untwisted carbon nanotube wire includes a plurality of carbon nanotubes substantially oriented along a same direction (e.g., a direction along the length of the untwisted carbon nanotube wire). The carbon nanotubes are substantially parallel to the axis of the untwisted carbon nanotube wire. Length of the untwisted carbon nanotube wire can be set as desired. The diameter of an untwisted carbon nanotube wire can range from about 0.5 nanometers to about 100 micrometers. In one embodiment, the diameter of the untwisted carbon nanotube wire is about 50 micrometers. Examples of the untwisted carbon nanotube wire is taught by US Patent Application Publication US 2007/0166223 to Jiang et al.

Figure 7:
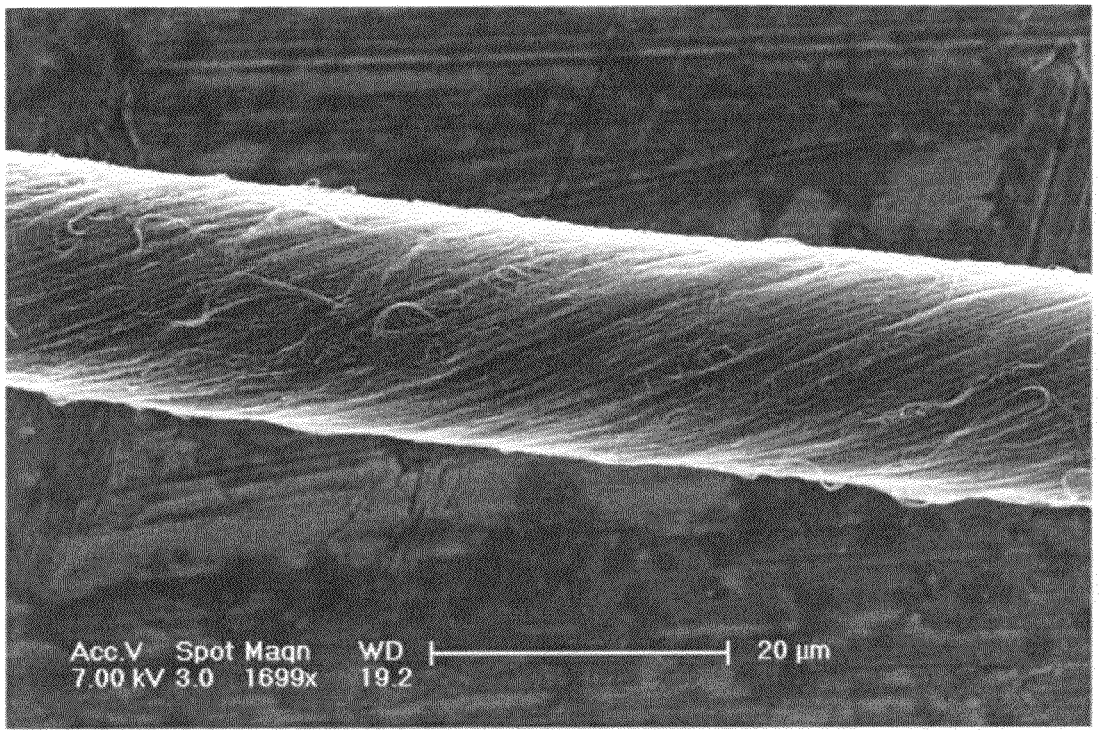
FIG. 7 shows a SEM image of a twisted carbon nanotube wire.

The twisted carbon nanotube wire can be formed by twisting a drawn carbon nanotube film by using a mechanical force to turn the two ends of the drawn carbon nanotube film in opposite directions. Referring to FIG. 7, the twisted carbon nanotube wire includes a plurality of carbon nanotubes oriented around an axial direction of the twisted carbon nanotube wire. Length of the carbon nanotube wire can be set as desired. The diameter of the twisted carbon nanotube wire can range from about 0.5 nanometers to about 100 micrometers. Further, the twisted carbon nanotube wire can be treated with a volatile organic solvent. After being soaked by the organic solvent, the adjacent paralleled carbon nanotubes in the twisted carbon nanotube wire will bundle together, due to the surface tension of the organic solvent when the organic solvent volatilizing. The specific surface area of the twisted carbon nanotube wire will decrease. The density and strength of the twisted carbon nanotube wire will be increase.

Figure 8:
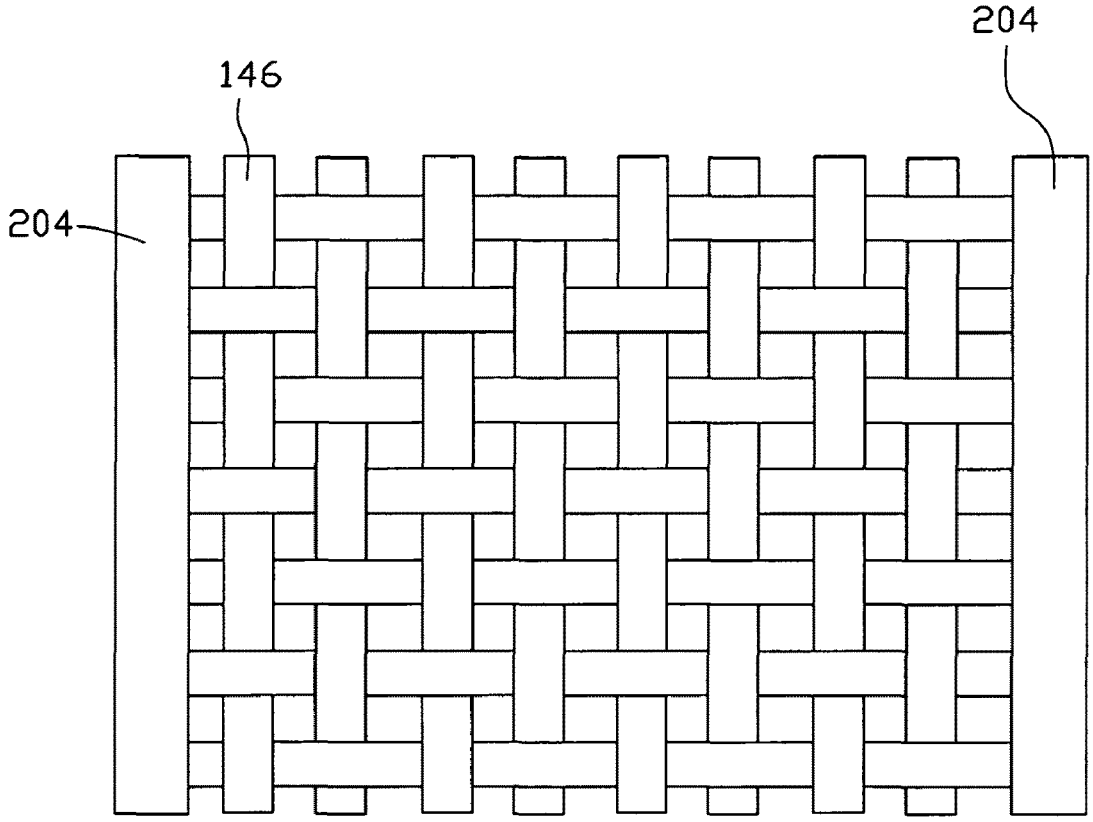
FIG. 8 shows a textile formed by a plurality of carbon nanotube wire structures or films.

The carbon nanotube structure 202 can include a plurality of carbon nanotube wire structures. The plurality of carbon nanotube wire structures can be parallel with each other, cross with each other, weaved together, or twisted with each other to form a planar structure. Referring to FIG. 8, a textile can be formed by the carbon nanotube wire structures 146 and used as the carbon nanotube structure 202. Two electrodes 204 can be located at two opposite ends of the textile and electrically connected to the carbon nanotube wire structures 146. It is also understood that carbon nanotube films can be cross with each other, weaved together, twisted with each other to form a planar structure, or form a textile as shown in FIG. 8.

It is understood that the carbon nanotube structure 202 can include a plurality of micropores. Thus, air can pass through carbon nanotube structure 202 between the outside and inside of the enclosure 210.

In the embodiment shown in FIG. 1, the sound wave generator 200 includes a carbon nanotube structure 202 comprising the drawn carbon nanotube film, and the drawn carbon nanotube film includes a plurality of carbon nanotubes arranged along a preferred direction. The length of the carbon nanotube structure 202 is about 5 millimeters, the width thereof is about 3 millimeters, and the thickness thereof is about 50 nanometers. It can be understood that when the thickness of the carbon nanotube structure 202 is small, for example, less than 10 micrometers, the sound wave generator 200 has greater transparency. Thus, it is possible to acquire a transparent loudspeaker 20 by employing a transparent carbon nanotube structure 202 comprising a transparent carbon nanotube film in a transparent enclosure 210.

The sound wave generator 200 can be fixed in the enclosure 210 by adhesive means such as a binder, or mechanical means. Because, some of the carbon nanotube structures 202 have large specific surface area, some of the carbon nanotube structure 202 can be adhered on the enclosure 210 merely by itself according to its adhesive nature.

It is to be understood that the loudspeaker 20 can include several sound wave generators disposed in the enclosure 210. The sound wave generators can in a carbon nanotube structure 202, electro-dynamic sound wave generators, electromagnetic sound wave generators, electrostatic sound wave generators and/or piezoelectric sound wave generators.

The loudspeaker 20 can further include wires (not shown) capable of transmitting electrical signals.

The sound wave generator 200 can further include at least two spaced electrodes 204 electrically connected to the carbon nanotube structure 202. The electrodes 204 can be disposed and fixed on two opposite ends of the carbon nanotube structure 202. Each electrode 204 is connected to a wire and is used to receive the electrical signals from the wire and transmit them to the carbon nanotube structure 202. In one embodiment, an amplifier is used to amplify the audio electrical signal includes two output ports. The two output ports are electrically connected to the two electrodes 204 by the wires. The amplified audio electrical signal is transmitted through the carbon nanotube structure 202 by the two electrodes 204. In another embodiment, one electrode receives an input while the other electrode is grounded.

When the carbon nanotubes in the carbon nanotube structure 202 are aligned along a same direction (such as the carbon nanotubes in the drawn carbon nanotube film or carbon nanotube segment film), the electrodes 204 can be disposed at two opposite ends of the aligned direction. Thus, the carbon nanotubes in the carbon nanotube structure 202 are aligned along the direction from one electrode 204 to the other electrode 204. The electrode 204 can be strip shaped and parallel to each other. The electrical signals are conducted to the carbon nanotube structure 202. The carbon nanotubes in the carbon nanotube structure 202 transform the electrical energy to the thermal energy. The thermal energy heats the medium, changes the density of the air, and thereby emits sound waves. No movement is required by the sound wave generator to create sound waves. Even if the sound wave generator is moving, it has minimal effect on the sound waves produced.

Figure 9:
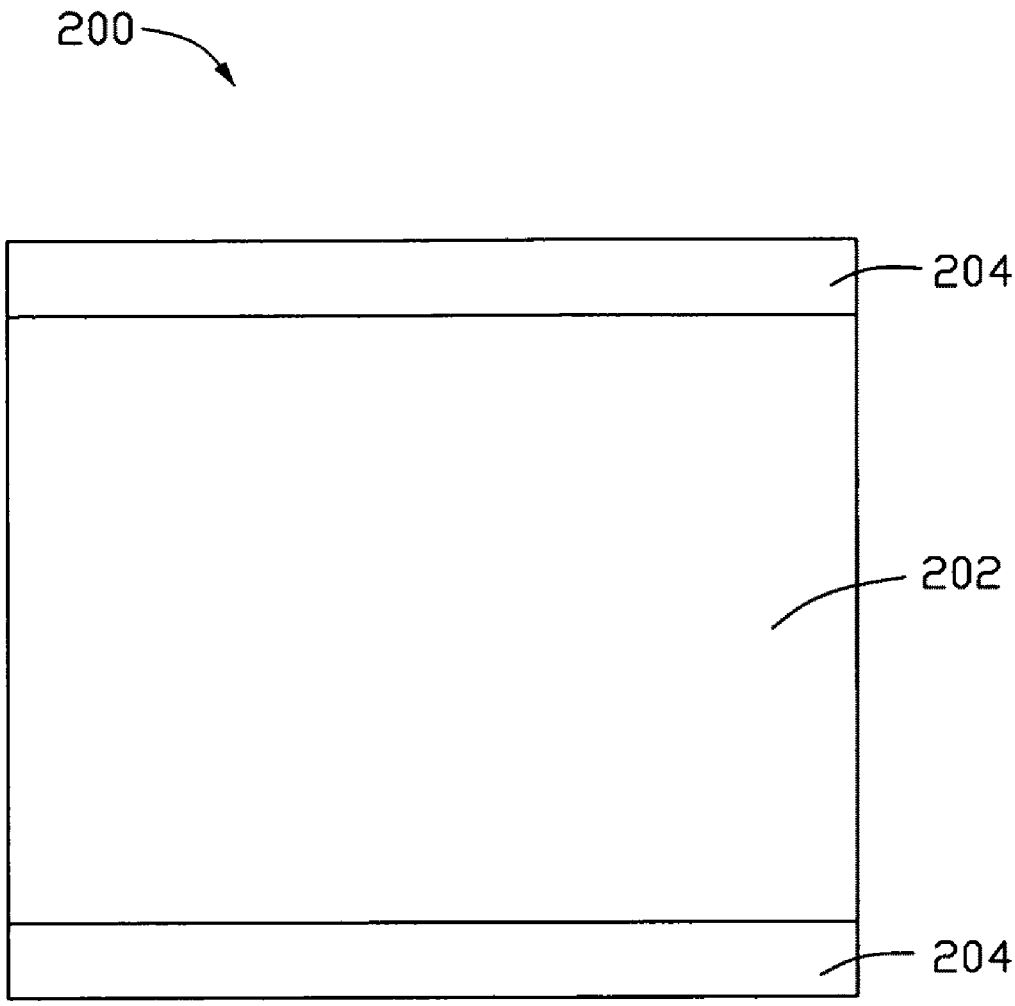
FIG. 9 is a schematic structural view of one kind of sound wave generator in the loudspeaker of FIG. 1.

Referring to FIG. 9, the carbon nanotube structure 202 can be a square, and the length of the strip shaped electrodes 204 can be equal to or longer than the length of two opposite edges of the carbon nanotube structure 202. Thus, when the electrodes 204 are disposed along the opposite edges of the carbon nanotube structure 202, all the carbon nanotube structure 202 can be electrically conductive, resulting in maximum use of the entire carbon nanotube structure 202. In this embodiment, the carbon nanotube structure 202 includes a drawn carbon nanotube film, and the carbon nanotubes in the carbon nanotube structure 202 are aligned along the direction from one electrode 204 to the other electrode 204. It is also noted, that if there is a tear in the carbon nanotube structure 202, sound can still be produced as long as there is some connection between the two electrodes 204.

Figure 10:
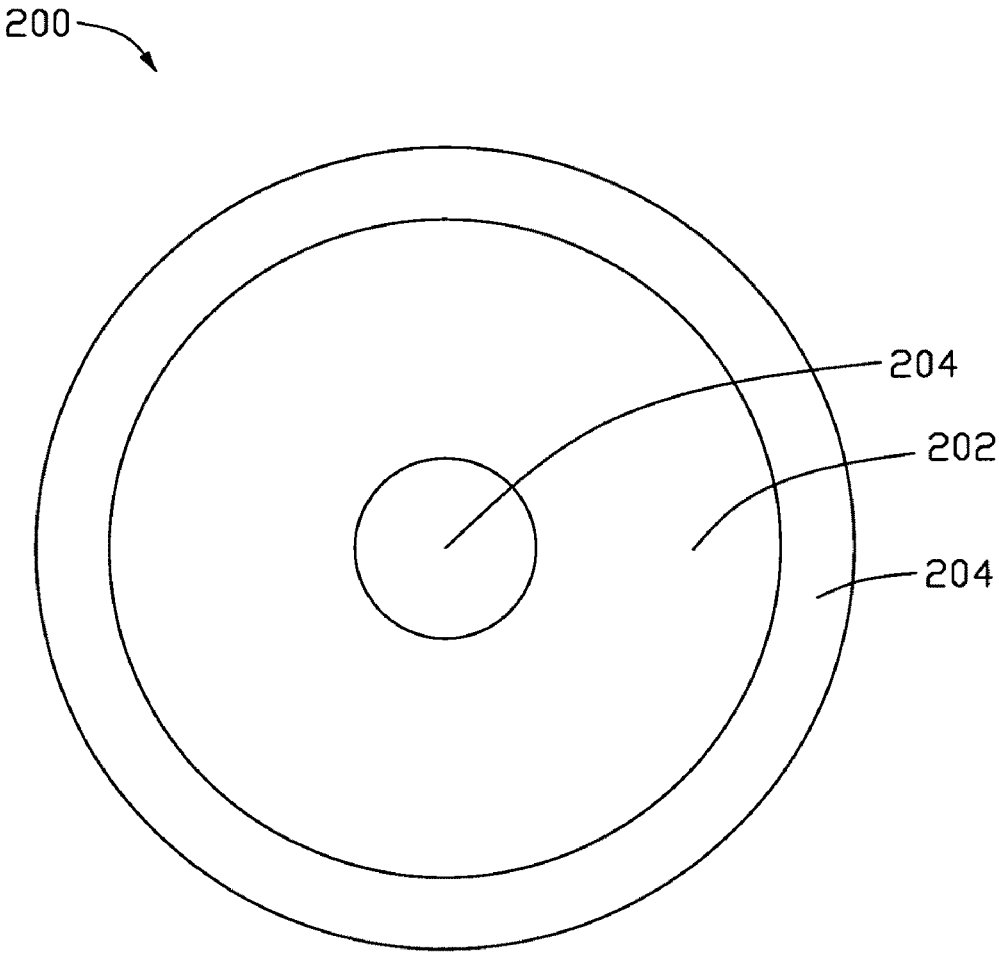
FIG. 10 is a schematic structural view of another kind of sound wave generator in the loudspeaker of FIG. 1.

Referring to FIG. 10, the carbon nanotube structure 202 can be round with one electrode 204 disposed at the edge of the carbon nanotube structure 202 and another electrode 204 disposed at the center of the carbon nanotube structure 202. The carbon nanotube structure 202 can have carbon nanotubes aligned radially from the center of the carbon nanotube structure 202. In one embodiment, a plurality of drawn carbon nanotube films or carbon nanotube wire structures can be radially arranged corresponding and to a round electrode 204 at a central point, wherein the drawn carbon nanotube films may have relatively narrow width.

The electrodes 204 are made of conductive material. The shape of the electrodes 204 is not limited and can be selected from a group consisting of lamellar, rod, wire, block and other shapes. A material of the electrodes 204 can be selected from a group consisting of metals, conductive adhesives, carbon nanotubes, and indium tin oxides. In one embodiment, the electrodes 204 are layer formed by silver paste.

In another embodiment, the electrodes 204 can be a metal rod and provide structural support for the carbon nanotube structure 202. Because, some of the carbon nanotube structures 202 have large specific surface area, some carbon nanotube structures 202 can be adhered directly to the electrodes 204. This will result in a good electrical contact between the carbon nanotube structures 202 and the electrodes 204. The two electrodes 204 can be electrically connected to two output ports of a signal input device by the wires (not shown) to receive the amplified signals.

In other embodiment, a conductive adhesive layer (not shown) can be further provided between the carbon nanotube structures 202 and the electrodes 204. The conductive adhesive layer can be applied to the surface of the carbon nanotube structures 202. The conductive adhesive layer can be used to provide electrical contact and more adhesion between the electrodes 204 and the carbon nanotube structures 202. In one embodiment, the conductive adhesive layer is a layer of silver paste.

In addition, it can be understood that the electrodes 204 are optional. The carbon nanotube structures 202 can be directly connected to the signal input device. Any way that can electrically connect the signal input device to the carbon nanotube structures 202 and thereby input electrical signal to the carbon nanotube structures 202 can be adopted.

The carbon nanotube structure 202 is in communication with a surrounding medium. Energy of the electrical signals is absorbed by the carbon nanotube structure 202 and the resulting energy will then be radiated as heat. This heating causes detectable sound signals due to pressure variation in the surrounding (environmental) medium such as air. Thus a thermal-acoustic effect is created. The input electrical signals can be audio frequency electrical signals.

The carbon nanotube structure 202 includes a plurality of carbon nanotubes and has a small heat capacity per unit area and can have a large area for causing the pressure oscillation in the surrounding medium by the temperature waves generated by the sound wave generator 200. In use, when signals, e.g., electrical signals, with variations in the application of the signal and/or strength are input applied to the carbon nanotube structure 202 of the sound wave generator 200, repeated heating is produced in the carbon nanotube structure 202 according to the variations of the signal and/or signal strength. Temperature waves, which are propagated into surrounding medium, are obtained. The temperature waves produce pressure waves in the surrounding medium, resulting in sound generation. In this process, it is the thermal expansion and contraction of the medium in the vicinity of the carbon nanotube structure 202 that produces sound. This is distinct from the mechanism of the conventional loudspeaker, wherein the pressure waves are created by the mechanical movement of the diaphragm. Thus movement of the speaker will have minimal effect on sound produce when compared to a conventional speaker relying on mechanical movement. The operating principle of the sound wave generator 200 is "electrical-thermal-sound" conversion.

Figure 11:
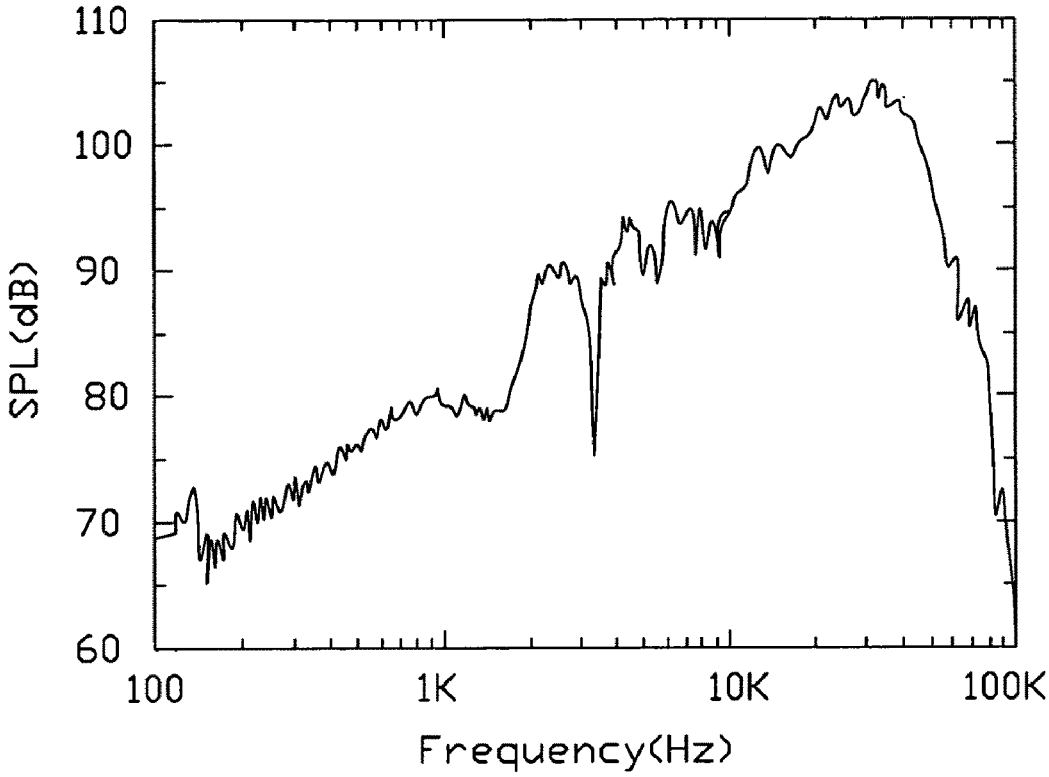
FIG. 11 is a frequency response curve of a sound wave generator according to one embodiment.

FIG. 11 shows a frequency response curve of the carbon nanotube structure 202 including a single carbon nanotube film, and having a length and width of 30 millimeters. The carbon nanotube film in this embodiment is a drawn carbon nanotube film. To obtain these results, an alternating electrical signal with 50 voltages is applied to the carbon nanotube structure 202. A microphone was put in front of the carbon nanotube structure 202 at a distance of about 5 centimeters away from the carbon nanotube structure 202. As shown in FIG. 11, the carbon nanotube structure 202 has a wide frequency response range and a high sound pressure level. The sound pressure level of the sound waves generated by the carbon nanotube structure 202 can be greater than 50 dB at a distance of 5 cm between the carbon nanotube structure 202 and a microphone. The sound pressure level generated by the loudspeaker 20 reaches up to 105 dB. The frequency response range of the carbon nanotube structure 202 can be from about 1 Hz to about 100 KHz with power input of 4.5 W. The total harmonic distortion of this carbon nanotube structure 202 is extremely small, e.g., less than 3% in a range from about 500 Hz to 40 KHz.

In one embodiment, the carbon nanotube structure 202 includes five carbon nanotube wire structures, and each of the carbon nanotube wire structures includes a carbon nanotube wire. A distance between adjacent two carbon nanotube wire structures is 1 centimeter, and a diameter of the carbon nanotube wire structures is 50 micrometers, when an alternating electrical signals with 50 voltages is applied to the carbon nanotube structure 202, the sound pressure level of the sound waves generated by the loudspeaker 20 can be greater than about 50 dB, and less than about 95 dB. The sound wave pressure generated by the loudspeaker 20 reaches up to 100 dB. The frequency response range of one embodiment loudspeaker 20 can be from about 100 Hz to about 100 KHz with power input of 4.5 W.

Further, since the carbon nanotube structure 202 has an excellent mechanical strength and toughness, the carbon nanotube structure 202 can be tailored to any desirable shape and size, allowing a loudspeaker of most any desired shape and size to be achieved.

Figure 12:
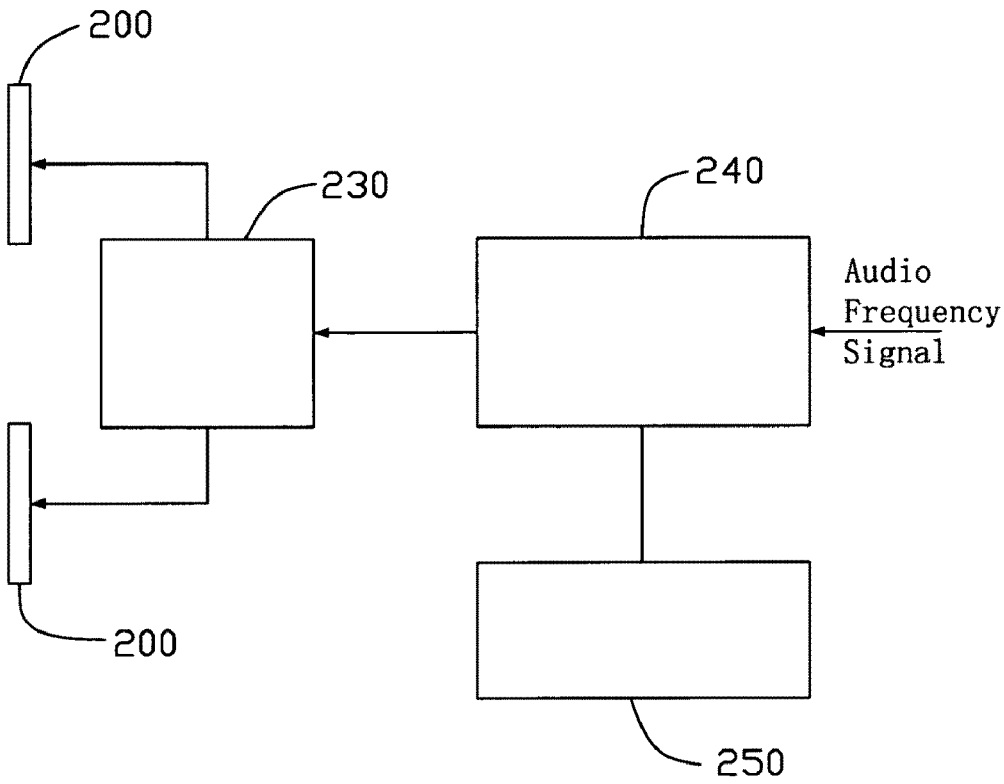
FIG. 12 is a block diagram of a circuit of the loudspeaker in FIG. 1.

Further, the loudspeaker 20 can include an audio crossover filter 230 inside the enclosure 210. Referring to FIG. 12, the audio crossover filter 230 includes several output ends and an input end. The output ends are separately connected to corresponding sound wave generators 200. The audio electrical signal is input to the audio crossover filter 230 from the input end. The audio crossover filter 230 filters the audio electrical signal into several bands, such as intermediate frequency, high frequency, and low frequency. The audio electrical signals in different bands are transmitted to different sound wave generators 200 (such as a tweeter and a woofer).

Further, the active loudspeaker 20 can include an amplifying circuit 240 and a power circuit 250 inside the enclosure 210. The power circuit 250 and the amplifying circuit 240 are electrically connected therebetween. The power circuit 250 drives the amplifying circuit 240 to amplify the input audio electrical signals. The amplifying circuit 240 is coupled to the sound wave generator 200. In one embodiment, the amplifying circuit 240 is electrically connected to the audio crossover filter 230. In use, the input audio electrical signals are amplified by the amplifying circuit 240 and transmitted to the audio crossover filter 230, and then transmitted to the sound wave generator 200. The passive loudspeaker 20 can be electrically connected to an amplifier outside the enclosure 210.

Figure 13:
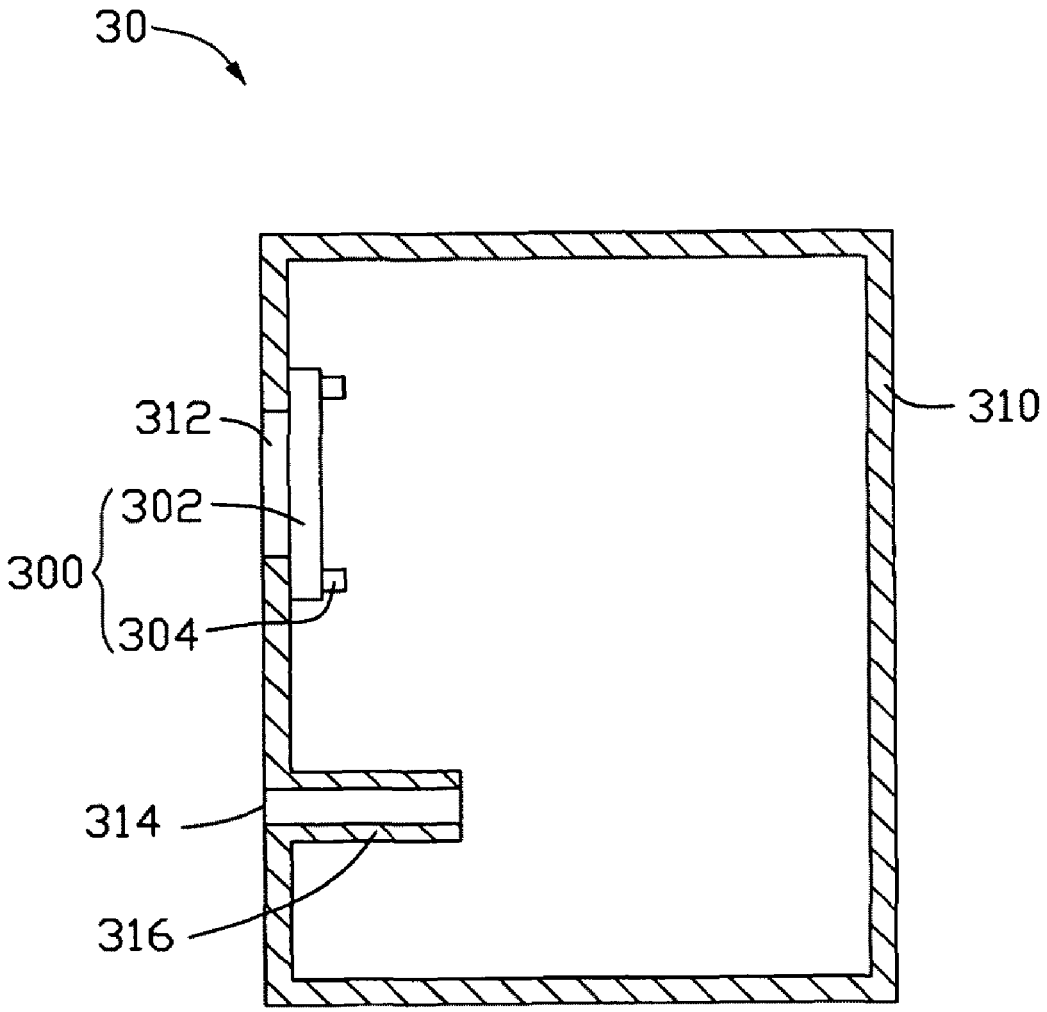
FIG. 13 is a schematic structural view of a loudspeaker in accordance with a second embodiment.

Referring to FIG. 13, a bass reflex type loudspeaker 30 according to a second embodiment includes an enclosure 310, and at least one sound wave generator 300 disposed inside the enclosure 310. The at least one sound wave generator 300 includes a carbon nanotube structure 302 and at least two electrodes 304. The at least two electrodes 304 are spaced from each other and electrically connected to the carbon nanotube structure 302.

The structure of the bass reflex type loudspeaker 30 in the second embodiment is similar to the structure of the closed box type loudspeaker 20 in the first embodiment. The difference is that the bass reflex type loudspeaker 30 further includes a duct 316 inside the enclosure 310. The duct 316 is connected to the enclosure 310. More specifically, the enclosure 310 includes at least one first through hole 312 and at least one second through hole 314. The second through hole 314 is defined through the duct 316. The sound wave generator 300 is associated with the first through hole 314. In one embodiment, the sound wave generator 300 covers the first through hole 314.

The inside of the enclosure 310 communicates acoustically with the outside through the through hole 314, via the duct 316. The duct 316 and the interior of the enclosure 310 form a Helmholtz resonator with resonance frequency determined by the compliance of the air volume inside the enclosure 310 and the air mass inside the duct 316.

Figure 14:
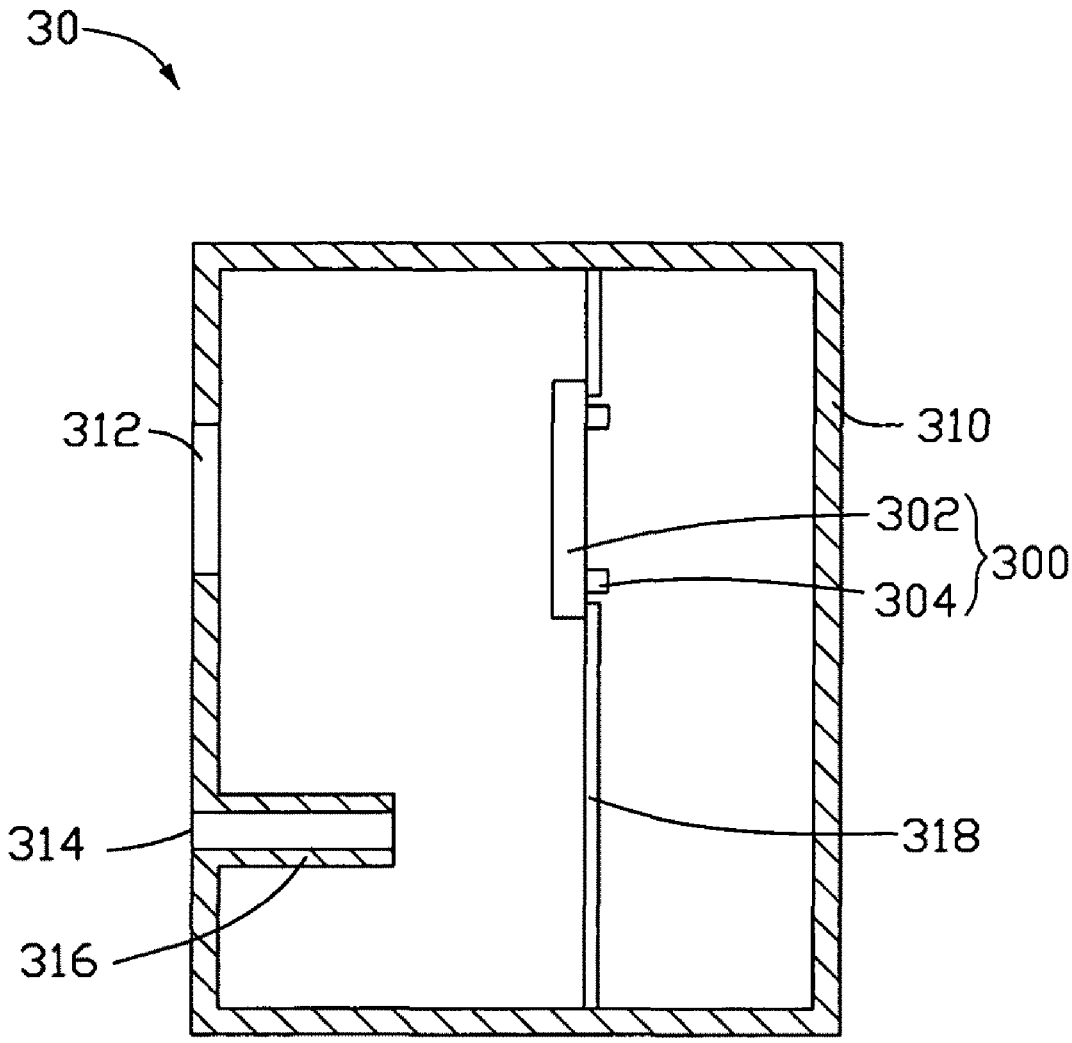
FIG. 14 is a schematic structural view of a loudspeaker with a framing element in accordance with a second embodiment.

Referring to FIG. 14, in one embodiment, the sound wave generator 300 can be spaced from the first through hole 312. More specifically, the sound wave generator 300 can be fixed by a framing element 318 inside the enclosure 310. The sound wave generator 300 is attached to the framing element 318, thus a portion of the sound wave generator 300 is suspended.

Figure 15:
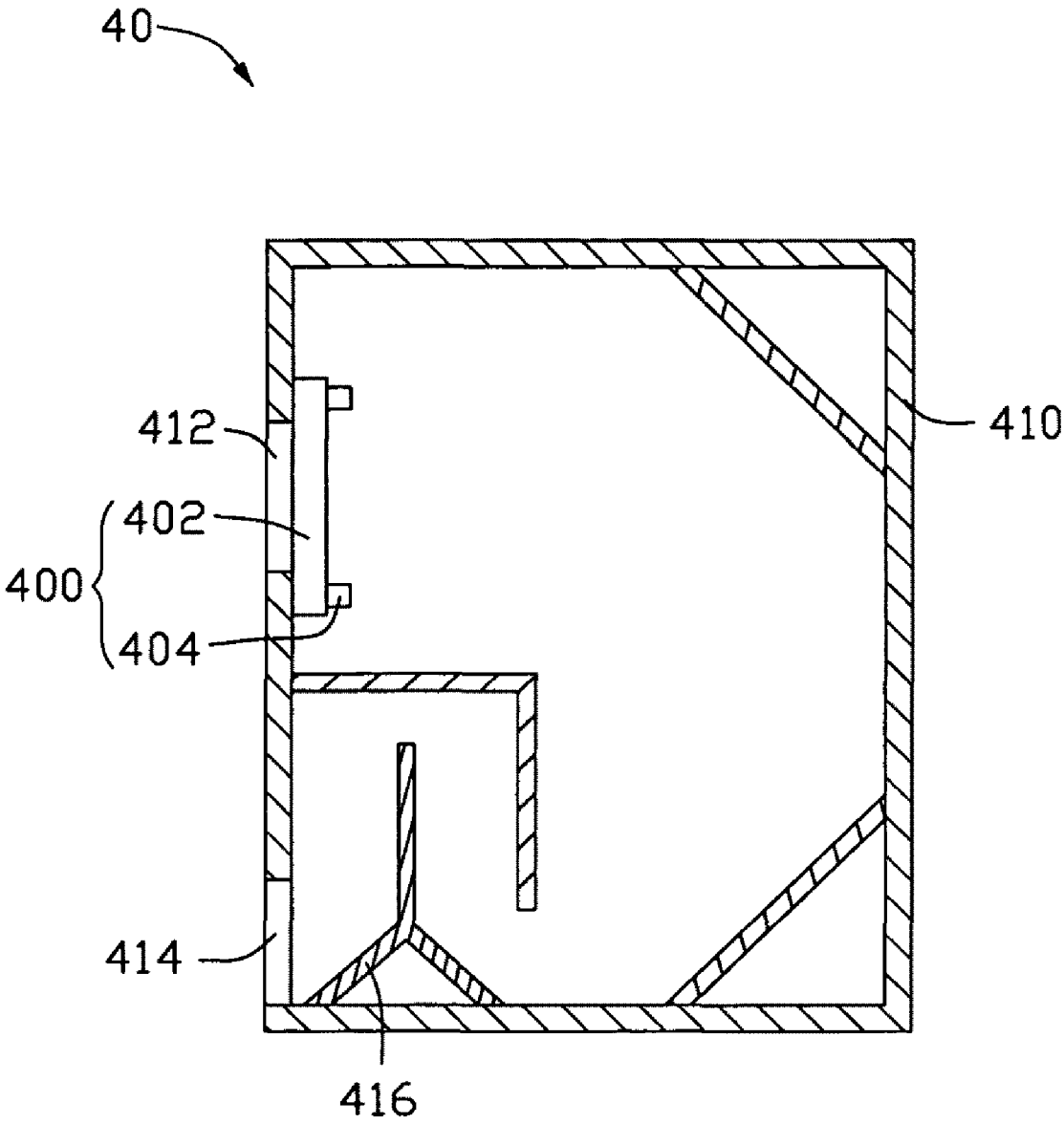
FIG. 15 is a schematic structural view of a loudspeaker in accordance with a third embodiment.

Referring to FIG. 15, a labyrinth type loudspeaker 40 according to a third embodiment includes an enclosure 410, and at least one sound wave generator 400 disposed inside the enclosure 410. The at least one sound wave generator 400 includes a carbon nanotube structure 402 and at least two spaced electrodes 404 electrically connected to the carbon nanotube structure 402.

The structure of the labyrinth type loudspeaker 40 in the third embodiment is similar to the structure of the closed box type loudspeaker 20 in the first embodiment. The difference is that the labyrinth type loudspeaker 40 further includes a plurality of partitions 416 inside the enclosure 410. More specifically, the enclosure 410 includes at least one first through hole 412 and at least one second through hole 414. The partitions 415 in the enclosure 410 form a labyrinth between the sound wave generator 400 and the second through hole 414. Sound passes through the labyrinth to the outside of the enclosure 410. The sound wave generator 400 faces the first through hole 412. In one embodiment, the sound wave generator 400 covers the first through hole 412. In another embodiment, the sound wave generator 400 is spaced from the first through hole 412.

Figure 16:
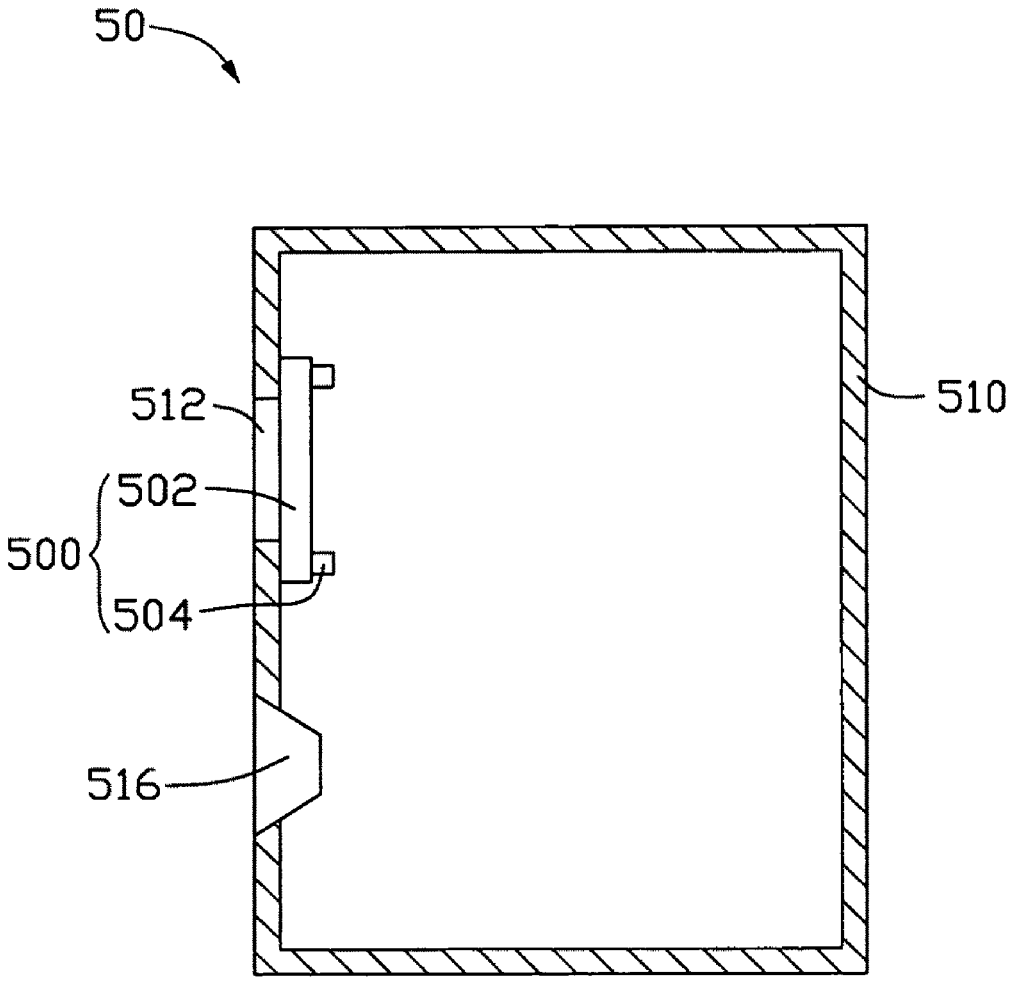
FIG. 16 is a schematic structural view of a loudspeaker in accordance with a fourth embodiment.

Referring to FIG. 16, a passive radiator type loudspeaker 50 according to a fourth embodiment includes an enclosure 510 and at least one sound wave generator 500 disposed inside the enclosure 510. The at least one sound wave generator 500 includes a carbon nanotube structure 502 and at least two spaced electrodes 504 electrically connected to the carbon nanotube structure 502.

The structure of the passive radiator type loudspeaker 50 in the fourth embodiment is similar to the structure of the closed box type loudspeaker 20 in the first embodiment. The difference is that the passive radiator type loudspeaker 50 further includes at least one passive radiator 516 inside the enclosure 510. More specifically, the enclosure 510 includes at least one first through hole 512 and at least one second through hole 514. The passive radiator 516 is mounted on the second through hole 514. In one embodiment, the passive radiator 516 is an electro-dynamic loudspeaker cone including a membrane made of paper, resin, fiber, carbon fiber, or combinations thereof. In one embodiment, the sound wave generator 500 covers the first through hole 512. In another embodiment, the sound wave generator 500 is spaced from the first through hole 512.

Figure 17:
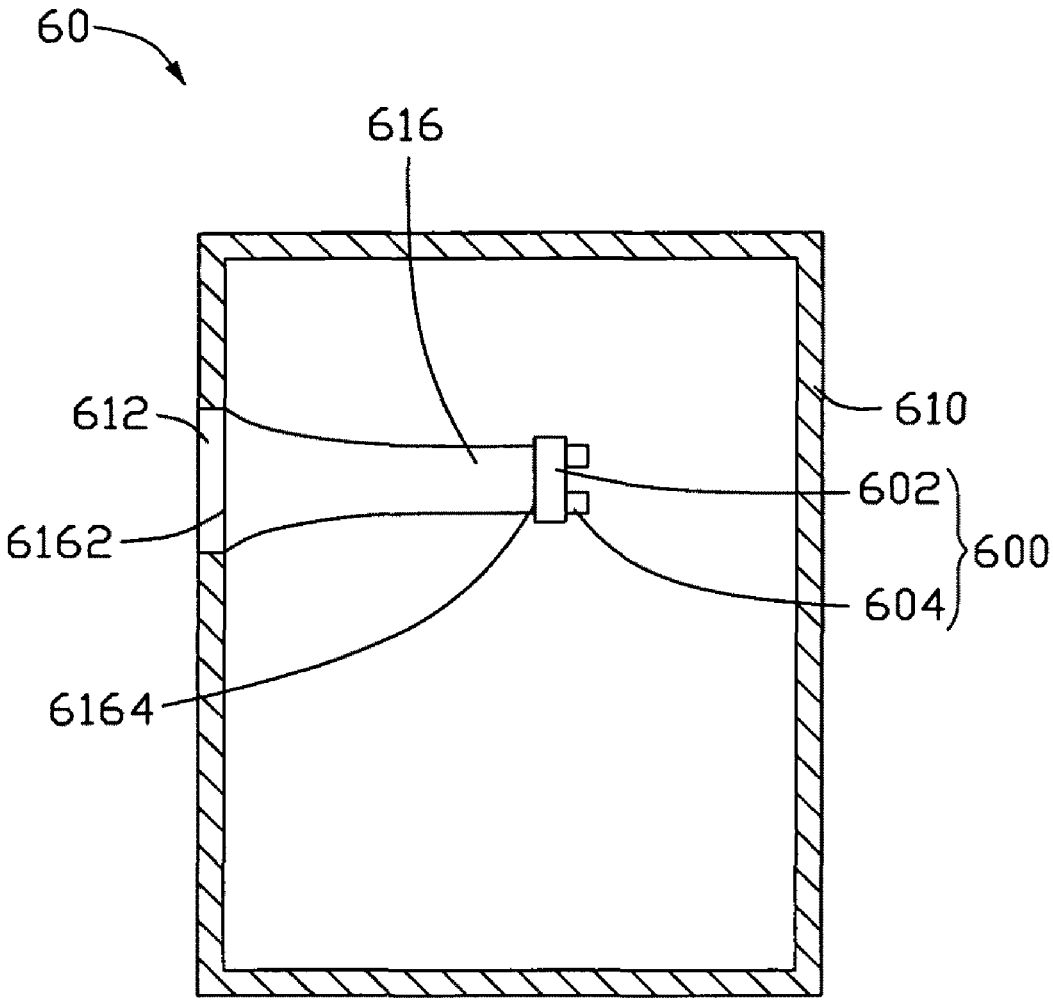
FIG. 17 is a schematic structural view of a loudspeaker in accordance with a fifth embodiment.

Referring to FIG. 17, a horn type loudspeaker 60 according to a fifth embodiment includes an enclosure 610, and at least one sound wave generator 600 disposed inside the enclosure 610. The at least one sound wave generator 600 includes a carbon nanotube structure 602 and at least two spaced electrodes 604 electrically connected to the carbon nanotube structure 602.

The structure of the horn type loudspeaker 60 in the fifth embodiment is similar to the structure of the closed box type loudspeaker 20 in the first embodiment. The difference is that the horn type loudspeaker 60 further includes a horn 616 inside the enclosure 610. More specifically, the horn 616 is mounted on the first through hole 612. The sound wave generator 600 covers the horn 616.

Figure 18:
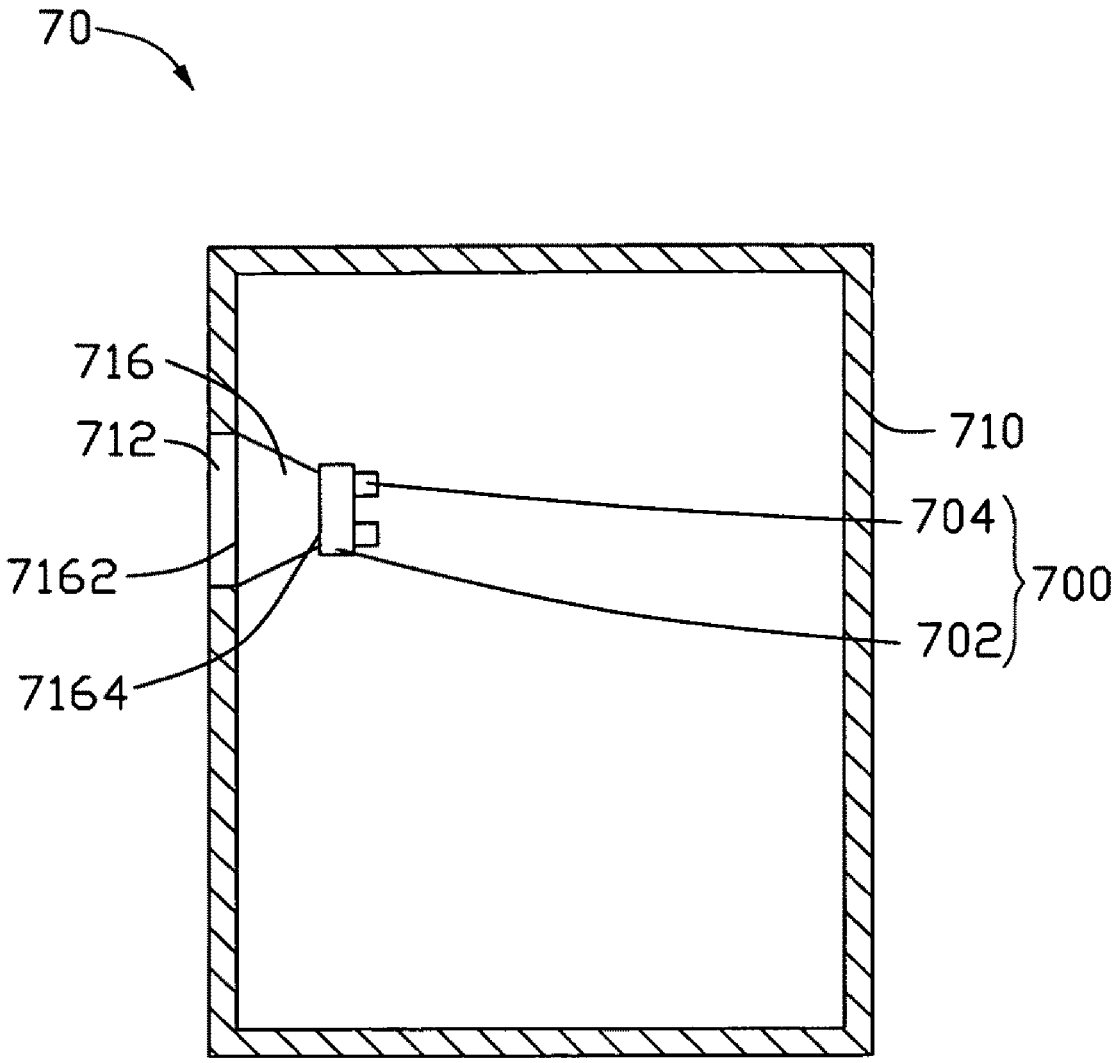
FIG. 18 is a schematic structural view of a loudspeaker in accordance with a sixth embodiment.
Figure 19:
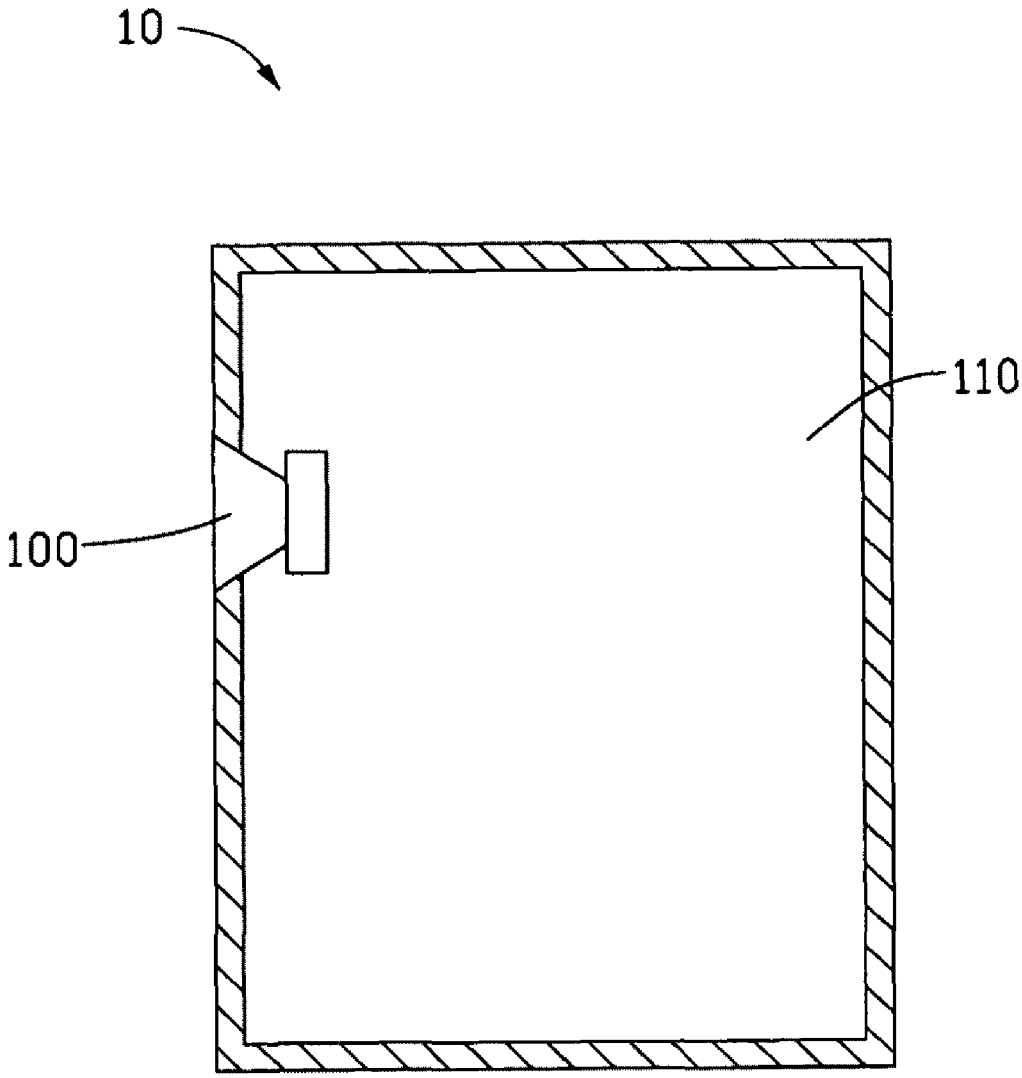
FIG. 19 (PRIOR ART)
FIG. 19 is a schematic structural view of a conventional loudspeaker according to the prior art.

Referring to FIG. 18, a loudspeaker 70 according to a sixth embodiment includes an enclosure 710, and at least one sound wave generator 700 disposed inside the enclosure 710. The at least one sound wave generator 700 includes a carbon nanotube structure 702 and at least two spaced electrodes 704 electrically connected to the carbon nanotube structure 702.

The structure of the loudspeaker 70 in the sixth embodiment is similar to the structure of the closed box type loudspeaker 20 in the first embodiment. The difference is that the loudspeaker 70 further includes a passive radiator 716 inside the enclosure 710. More specifically, the passive radiator 716 is mounted on the first through hole 712. The passive radiator 516 can be an electro-dynamic loudspeaker cone including a membrane made of paper, resin, fiber, carbon fiber, or combinations thereof. The passive radiator 516 has an opening at the center. The sound wave generator 700 covers the opening of the passive radiator 716.

It is to be understood that the present disclosure also refers to other kinds of loudspeakers beside the above embodiments, that adopt a carbon nanotube structure in an enclosure thereof.

The sound wave generator in the loudspeaker employing the carbon nanotube structure does not require any magnet or other complicated structure. The structure of the loudspeaker is simple and decreases the cost of the production. Space in the enclosure is saved. Also the enclosures that use the carbon nanotube structure are not as required to be as robust given that there is no dynamic stresses caused by moving parts, nor support of the extra weight required. The carbon nanotube structure transforms the electric energy to heat that causes surrounding air expansion and contraction according to the same frequency of the input signal and results a hearable sound pressure. Thus, the loudspeaker can work without a vibration film and the magnetic field. The carbon nanotube structure can provide a wide frequency response range (1 Hz to 100 kHz), and a high sound pressure level. The carbon nanotube structure can be cut into any desirable shape and size that meet different needs of different kinds of loudspeakers. The carbon nanotube structure can be very small, and thus the size of the loudspeaker can be decreased and used in environments where traditional loud speakers could not be employed. The carbon nanotube structure has a large specific area, and is sticky in nature. The carbon nanotube structure can be directly adhered on the inner wall of the enclosure.

Finally, it is to be understood that the above-described embodiments are intended to illustrate rather than limit the invention. Variations may be made to the embodiments without departing from the spirit of the invention as claimed. Elements associated with any of the above embodiments are envisioned to be associated with any other embodiments. The above-described embodiments illustrate the scope of the invention but do not restrict the scope of the invention.

What is claimed is:

1. A loudspeaker, the loudspeaker comprising:

an enclosure; and at least one sound wave generator disposed in the enclosure, wherein the at least one sound wave generator comprising at least one carbon nanotube structure, the carbon nanotube structure is capable of converting electrical signals into heat and transferring the heat to a medium in contact with the at least one carbon nanotube structure to cause a thermoacoustic effect.

2. The loudspeaker of claim 1, wherein the carbon nanotube structure is free-standing.

3. The loudspeaker of claim 1, wherein the carbon nanotube structure produces sounds in response to the electrical signals, the electrical signals are capable of causing the carbon nanotube structure to increase in temperature.

4. The loudspeaker of claim 1, wherein a heat capacity per unit area of the carbon nanotube structure is less than or equal to $2\times10^{-4}$ J/cm$^2$·K.

5. The loudspeaker of claim 1, wherein a frequency response range of the at least one sound wave generator ranges from about 1 Hz to about 100 KHz.

6. The loudspeaker of claim 1, wherein the carbon nanotube structure has a substantially planar structure, and a thickness of the carbon nanotube structure ranges from about 0.5 nanometers to about 1 millimeter.

7. The loudspeaker of claim 1, wherein the carbon nanotube structure comprises a plurality of carbon nanotubes, and the carbon nanotubes are combined by van der Waals attractive force therebetween.

8. The loudspeaker of claim 7, wherein the carbon nanotubes are arranged in a substantially systematic manner.

9. The loudspeaker of claim 7, wherein the carbon nanotubes are aligned substantially along a same direction.

10. The loudspeaker of claim 7, wherein the carbon nanotubes are joined end to end by van der Waals attractive force therebetween.

11. The loudspeaker of claim 1, wherein the carbon nanotube structure comprises at least one carbon nanotube film, at least one carbon nanotube wire, or at least one carbon nanotube film and the at least one carbon nanotube wire.

12. The loudspeaker of claim 1, further comprising at least two electrodes, the at least two electrodes are located apart from each other and electrically connected to the carbon nanotube structure.

13. The loudspeaker of claim 12, wherein the carbon nanotube structure comprises a plurality of carbon nanotubes, the carbon nanotubes in the carbon nanotube structure are aligned along a direction from one electrode to the other electrode.

14. The loudspeaker of claim 1, wherein the enclosure comprises at least one through hole, and the at least one sound wave generator covers the through hole.

15. The loudspeaker of claim 1, wherein the enclosure comprises a framing element, the sound wave generator is attached to the framing element.

16. The loudspeaker of claim 1, further comprising an audio crossover and a plurality of sound wave generators.

17. The loudspeaker of claim 1, further comprising an amplifying circuit and a power circuit, the amplifying circuit is connected to the power circuit and the at least one sound wave generator.

18. The loudspeaker of claim 1, wherein the enclosure comprises at least one element of a group consisting of a duct, a partition, a passive radiator, and a horn.

* * * * *